US007328485B2

(12) United States Patent
Oishibashi

(10) Patent No.: US 7,328,485 B2
(45) Date of Patent: Feb. 12, 2008

(54) FIBER SPREADING APPARATUS

(76) Inventor: Hiroji Oishibashi, 5-6, Showamachi 1-Chome, Katsuyama-Shi, Fukui-Ken (JP)

( * ) Notice: Subject to any disclaimer, the term of this patent is extended or adjusted under 35 U.S.C. 154(b) by 169 days.

(21) Appl. No.: 11/261,526

(22) Filed: Oct. 27, 2005

(65) Prior Publication Data

US 2006/0085958 A1 Apr. 27, 2006

(30) Foreign Application Priority Data

Oct. 27, 2004 (JP) ..... 2004-312585

(51) Int. Cl.
*D01G 21/00* (2006.01)

(52) U.S. Cl. ..... 19/65 R; 19/65 A

(58) Field of Classification Search ..... 19/65 R, 19/65 A; 492/28, 30, 33; 118/420
See application file for complete search history.

(56) References Cited

U.S. PATENT DOCUMENTS 1,136,431 A * 4/1915 Morse ..... 242/118.4
2,023,019 A * 12/1935 Heppes ..... 118/32
2,646,612 A * 7/1953 Shearer ..... 492/33
4,742,597 A * 5/1988 LaFlamme ..... 15/244.2
5,133,282 A 7/1992 Bates et al. ..... 118/420
6,007,465 A * 12/1999 Kawamura et al. ..... 492/30

FOREIGN PATENT DOCUMENTS

JP 2002-115143 4/2002
JP 2002-173846 6/2002

* cited by examiner

*Primary Examiner*—Shaun R. Hurley
(74) *Attorney, Agent, or Firm*—J.C. Patents

(57) ABSTRACT

A fiber spreading apparatus prevents a fiber bundle from being split apart. Position restriction rollers 43*g* and 43*h* are arranged in a fiber bundle streaming and feeding section 43 so as to restrict a streaming and feeding position of the fiber bundle 1. A spread width of the fiber bundle 1 is thereby restricted and the fiber bundle is prevented from being split apart. A squeezing roller mechanism 52, which is arranged outside of a liquid stored in a fiber spreading tank 40, guides the fiber bundle 1 from within the liquid in the fiber spreading tank 40 to the squeezing roller mechanism 52 while bringing the fiber bundle into constant contact with a first guide 51. By so configuring, a surface tension of the liquid acts to prevent the fiber bundle 1 from being split apart.

8 Claims, 4 Drawing Sheets

FIBER SPREADING APPARATUS

BACKGROUND OF THE INVENTION

1. Field of the Invention

The present invention relates to a fiber spreading system for spreading a fiber bundle consisting of a plurality of filaments.

2. Description of the Related Art

As conventional fiber spreading apparatuses, there are known one using an electrostatic fiber spreading method, one using a fiber pressing and spreading method, one using a fiber jet-spreading method, and one using an ultrasonic fiber spreading method. Among them, the fiber spreading apparatus using the ultrasonic fiber spreading method includes an ultrasonic generator in a predetermined liquid tank and a fiber bundle streaming and feeding section that streams and feeds a to-be-spread fiber bundle to this liquid tank, and that spreads the fiber bundle using a ultrasonic wave, as disclosed in Japanese Unexamined Patent Publication Nos. 70420 (1992) and 145556 (1995).

Nowadays, a fiber bundle consisting of an assembly of filaments, which are carbon fibers, is used to obtain a composite material semi-finished item such as a prepreg. A fiber spreading degree required for this fiber bundle is rapidly increased. For example, an untwisted carbon fiber bundle consisting of 12,000 filaments of 7 μm and having an original width of about 6 mm and an original thickness of about 0.13 to 0.16 mm is required to be spread to have a width of about 25 mm and a thickness of about 0.02 mm in a final fiber-spread state.

Under these circumstances, the inventor of the present invention proposed a fiber spreading system, identified by Japanese Patent No. 3382607. This fiber spreading system includes a preliminary fiber spreading apparatus and a regular fiber spreading apparatus. The preliminary fiber spreading apparatus includes a fiber bundle streaming and feeding section provided in a liquid for streaming and feeding a fiber bundle to a plurality of rollers to follow a bent path while a tension is applied to the fiber bundle and the fiber bundle is brought into contact with surfaces of the respective rollers, propagates an ultrasonic wave into the liquid, and spreads the fiber bundle in the fiber bundle streaming and feeding section. The regular fiber spreading apparatus further spreads the spread fiber bundle spread by the preliminary fiber spreading apparatus.

If fine filaments of about 7 μm are to be arranged to have the width of about 25 mm and the thickness of about 0.02 mm in the final fiber-spread state, then about 3600 filaments are arranged in a width direction but only about three to four filaments are arranged in a thickness direction. If the number of filaments in the thickness direction is far smaller than that in the width direction, the fiber bundle is more liable to be split apart.

For example, in the preliminary fiber spreading apparatus of the above-stated fiber spreading system, a fiber spreading action in the fiber bundle streaming and feeding section is increased with passage of time. If fiber spreading time is too long, the fiber bundle may possibly be already split apart at the time the fiber bundle is discharged from the fiber bundle streaming and feeding section. Due to this, the fiber spreading system is required to execute two-stage steps by the preliminary fiber spreading apparatus and the regular fiber spreading apparatus, respectively, and to excessively suppress the fiber spreading time of the preliminary fiber spreading so that the preliminary fiber spreading apparatus performs only preliminary fiber spreading.

In this fiber spreading system, the fiber is spread while being immersed in a liquid. If the fiber bundle is discharged outside of the liquid after the fiber spreading, then the filaments overlap one another by a surface tension of the liquid adhering to the fiber bundle, and the fiber bundle is split apart. To avoid such a disadvantage, the above-stated fiber spreading system includes a squeezing roller mechanism. The squeezing roller mechanism consists of a metal roller a part of which is immersed in the liquid and a rubber roller abutting this metal roller from above, and removes the liquid adhering to a spread-fiber sheet by causing the spread-fiber sheet to pass between the both rollers (see Japanese Patent No. 3382607, paragraph [0046]). However, if liquid removal efficiency of this squeezing roller mechanism is low, the fiber bundle is often split apart by the surface tension of the liquid even after the liquid is squeezed.

SUMMARY OF THE INVENTION

The present invention has been achieved in these circumstances. It is an object of the present invention to prevent a fiber bundle from being split apart and to improve yield.

According to a first aspect of the present invention, there is provided a fiber spreading apparatus for spreading a fiber bundle consisting of an assembly of a plurality of filaments in a fiber assembly streaming and feeding section that streams and feeds the fiber bundle to follow a bent path while a tension is applied to the fiber bundle and the fiber bundle is brought into contact with surfaces of a plurality of fiber spreading rollers, characterized in that the fiber bundle streaming and feeding section includes a position restriction roller that restricts a streaming and feeding position of the fiber bundle, a pair of flanges that restrict a spread width of the fiber bundle being provided on an outer circumferential portion of the position restriction roller.

In the fiber spreading apparatus according to the first aspect of the present invention, the paired flanges are provided on the outer circumference of the position restriction roller. The fiber bundle is not spread to exceed the flanges. By thus setting the upper limit of the spread width of the fiber bundle, the fiber bundle is prevented from being split apart.

According to a second aspect of the present invention, there is provided a fiber spreading apparatus for spreading a fiber bundle consisting of an assembly of a plurality of filaments in a fiber assembly streaming and feeding section that streams and feeds the fiber bundle to follow a bent path while a tension is applied to the fiber bundle and the fiber bundle is brought into contact with surfaces of a plurality of fiber spreading rollers, characterized in that the fiber bundle streaming and feeding section includes a position restriction roller that restricts a streaming and feeding position of the fiber bundle, and is configured to return the fiber bundle offset to one side or the other side of the position restriction roller in an axial direction to a center of the position restriction roller by tilting the position restriction roller.

In the fiber spreading apparatus according to the second aspect of the present invention, the streaming and feeding position of the fiber bundle is restricted by freely tilting the position restriction roller. More specifically, if the fiber bundle is offset to one side or the other side of the position restriction roller in the axial direction by the fiber spreading action of the fiber spreading rollers, the fiber bundle is returned to the center of the position restriction roller by tilting the position restriction roller. The spread width of the fiber bundle is thereby restricted and the fiber bundle is prevented from being split apart.

According to a third aspect of the present invention, there is provided a fiber spreading apparatus for spreading a fiber bundle consisting of an assembly of a plurality of filaments in a fiber bundle streaming and feeding section arranged in a liquid, and for squeezing the liquid adhering to the spread fiber bundle and removing the liquid using a squeezing roller mechanism, the fiber bundle streaming and feeding section streaming and feeding the fiber bundle to follow a bent path while a tension is applied to the fiber bundle and the fiber bundle is brought into contact with surfaces of a plurality of fiber spreading rollers, characterized in that the squeezing roller mechanism includes a first guide that is arranged outside the liquid stored in a fiber spreading tank, and that guides the fiber bundle from within the liquid in the fiber spreading tank to the squeezing roller mechanism while contacting with the fiber bundle without separating from the fiber bundle.

In the fiber spreading apparatus according to the third aspect of the present invention, the squeezing roller mechanism is arranged outside the liquid in the fiber spreading tank and squeezes the fiber bundle. Therefore, only the liquid squeezed out from the fiber bundle adheres to the squeezing roller mechanism. By thus preventing excessive liquid from adhering to the squeezing roller mechanism, efficiency for removing the liquid from the fiber bundle is enhanced and the fiber bundle is thereby prevented from being split apart. By arranging the squeezing roller mechanism outside the liquid, a surface tension of the liquid acts on the fiber bundle while the bundle is streamed and fed from within the liquid in the fiber spreading tank to the squeezing roller mechanism. During this time, the surface tension of the liquid is suppressed by always contacting the fiber bundle with the first guide.

If the drier section that winds the fiber bundle streamed and fed from the squeezing roller mechanism around a drying roller and that dries the fiber bundle is provided, the squeezing roller mechanism includes a second guide that guides the fiber bundle from the squeezing roller mechanism to the drying roller while always contacting with the fiber bundle. By always contacting the fiber bundle with the second guide while the fiber bundle is streamed and fed from the squeezing roller mechanism to the drying roller, the surface tension of the liquid is suppressed even if the liquid remains on the fiber bundle squeezed by the squeezing roller mechanism.

Although the fiber spreading apparatus according to the third aspect of the present invention is applicable only to fiber spreading in the liquid, the apparatuses according to the first and the second aspects are applicable to the fiber spreading not only in the liquid but also in the gas.

According to the present invention, the fiber spreading apparatus is configured as stated above to prevent the fiber bundle from being split apart while or after the fiber bundle is spread in the fiber streaming and feeding section. It is, therefore, possible to improve yield. Further, according to the present invention, the fiber bundle can be spread to have a desired width and a desired thickness in single-stage steps without executing two-stage steps of the preliminary fiber spreading steps and the regular fiber spreading steps. It is, therefore, possible to reduce apparatus cost, scale down the apparatus, and perform the fiber spreading operation at low cost.

DESCRIPTION OF THE PREFERRED EMBODIMENT

A fiber spreading apparatus according to one embodiment of the present invention will be described hereinafter with reference to the drawings.

Figure 1:
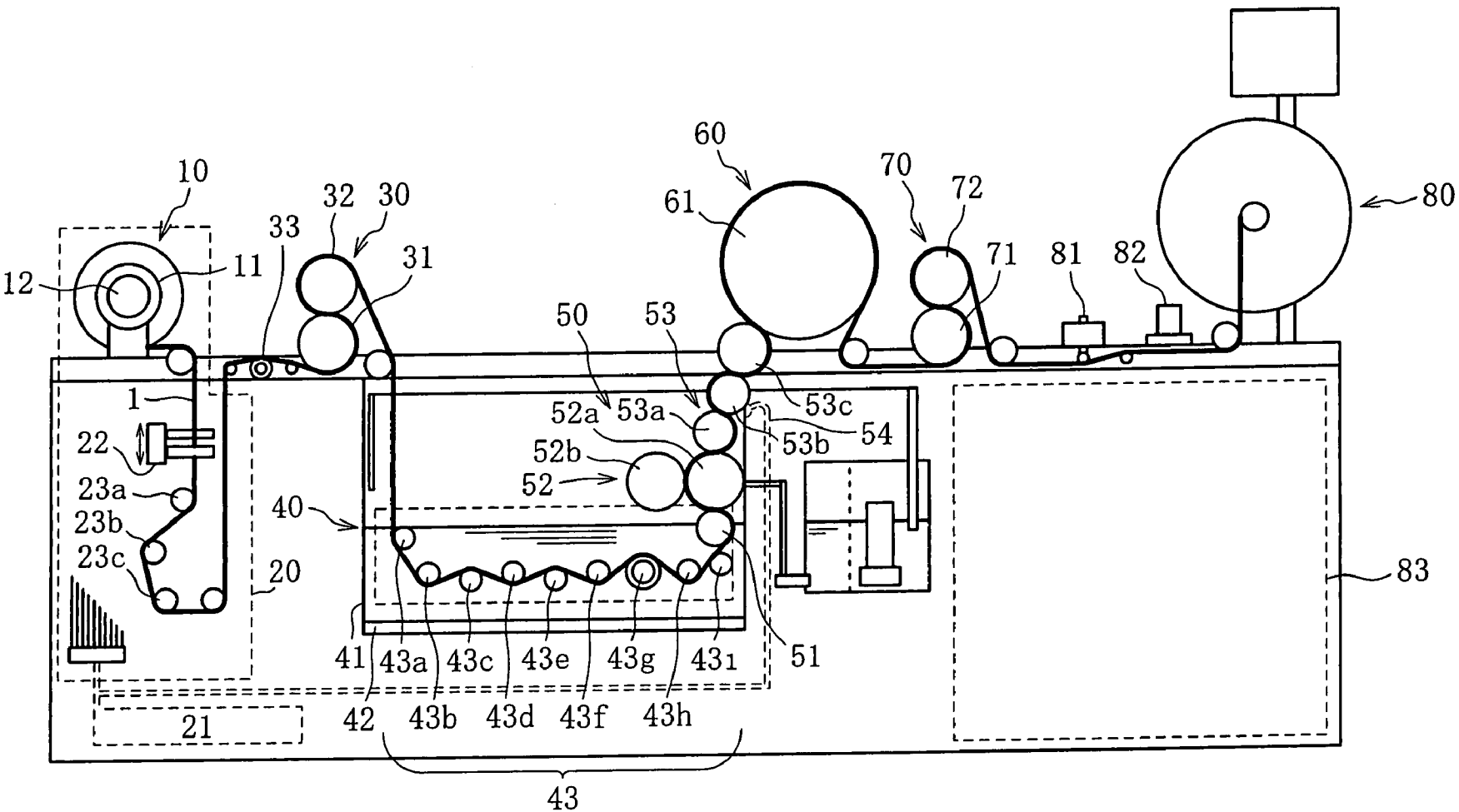
FIG. 1 is an elevation that depicts a schematic configuration of a fiber spreading apparatus according to one embodiment of the present invention.

FIG. 1 is a schematic elevation that depicts the fiber spreading apparatus according to one embodiment of the present invention. This fiber spreading apparatus spreads a fiber bundle 1 consisting of an assembly of a plurality of untwisted filaments. An example of such a fiber bundle 1 includes an untwisted carbon fiber bundle that is a bundle of 12,000 filaments of 7 μm, and that has an original width of about 6 mm and an original thickness of about 0.16 mm. The apparatus according to the present invention spreads the fiber bundle 1 up to a width of about 25 mm and a thickness of about 0.02 mm.

As shown in FIG. 1, this fiber spreading apparatus 1 includes, as principal constituent elements, a yarn feeding section 10, a heating chamber 20, a driven shaft driving roller mechanism 30, a fiber spreading tank 40, a squeezing guide section 50, a drier section 60, a main shaft driving roller mechanism 70, and a take-up section 80.

With this configuration, the fiber bundle 1 can be drawn from a yarn feeding bobbin 11 provided in the yarn feeding section 10, subjected to a predetermined fiber spreading processing, and taken up in the take-up section 80. The fiber bundle 1 is drawn from the yarn feeding section 10 by driving forces of the driven shaft driving roller mechanism 30, the main shaft driving roller mechanism 70, and the take-up section 80. Tension applied to the fiber bundle 1 is appropriately adjusted by contact forces of the driven shaft driving roller mechanism 30 and the main shaft driving roller mechanism 70 by which the mechanism 30 and 70 contact with the fiber bundle 1, and a torque of the take-up section 80. A torque limiter 12 is provided in the yarn feeding section 10 so as to prevent overload from being applied to the fiber bundle 1.

The heating chamber 20 heats the fiber bundle 1 drawn from the yarn feeding section 10 by a hot wind supplied from a heat source 21 such as a far-infrared ray generator. The fiber bundle 1 is coated with a sizing agent (size) in advance to enhance an assembly property of filaments and adhesiveness of the fiber bundle 1 to resin. This sizing agent is coated on the fiber bundle 1 unevenly in a length direction and a width direction of the fiber bundle 1. Due to this, it is difficult to uniformly spread such fiber bundle 1 even if it is possible to do so. By heating the fiber bundle 1 prior to fiber spreading, the sizing agent bonded to the fiber bundle 1 is softened and a filament constraint state is relaxed. As a result, a spread width of the fiber bundle 1 can be stabilized.

A position adjuster 22 for the fiber bundle 1 and a plurality of inclined rollers 23*a*, 23*b*, and 23*c* are arranged in the heating chamber 20. The fiber bundle 1 is traverse wound around the yarn feeding bobbin 11. Due to this, if the fiber bundle 1 is drawn from the yarn feeding section 10, a streaming and feeding position of the fiber bundle 1 is not constant. This position adjuster 22 makes the streaming and feeding position of the fiber bundle 1 constant. This position adjuster 22, which is a roller position adjuster, sandwiches the fiber bundle 1 between a pair of rollers and reciprocates along the fiber bundle 1 thus streamed and fed, thereby adjusting the streaming and feeding position of the fiber bundle 1. The fiber bundle 1 is twisted by a predetermined angle by a position adjustment made by the roller position adjuster 22. The inclined rollers 23*a*, 23*b*, and 23*c* function to untwist the fiber bundle 1. In this embodiment, a plurality of inclined rollers 23*a*, 23*b*, and 23*c* are provided so as to gradually untwist the fiber bundle 1.

The driven shaft driving roller mechanism 30 consists of a pair of rollers 31 and 32 arranged proximate to each other. One of the rollers is the driven shaft driving roller 31 and the other roller is the press roller 32. The press roller 32 presses the driven shaft driving roller 31 via the fiber bundle 1, whereby a contact force of the fiber bundle 1 by which the fiber bundle 1 contacts with the driven shaft driving roller 31 is intensified and a driving force of the driven shaft driving roller 31 is transmitted to the fiber bundle 1. Conversely, if the press roller 32 is separated from the driven shaft driving roller 31, the driving force of the driven shaft driving roller 31 is hardly transmitted to the fiber bundle 1. In FIG. 1, reference symbol 33 denotes a position stabilizing variable roller, which adjusts the position of the fiber bundle 1 so as to be guided to a desired position (e.g., a center) of the driven shaft driving roller 31.

The fiber spreading tank 40 includes a liquid tank 41 that stores a liquid such as water, an ultrasonic generator 42 that propagates an ultrasonic wave into the liquid within the liquid tank 41, and a fiber bundle streaming and feeding section 43 that follows a bent path and streams and feeds the fiber bundle 1 while contacting with the fiber bundle 1. The fiber bundle streaming and feeding section 43 includes a plurality of rollers 43*a* to 43*i* arranged in the liquid. The rollers 43*a* and 43*i* on both ends are an inlet roller and an outlet roller, respectively, and the fiber spreading rollers 43*b* to 43*f* and the position restriction rollers 43*g* and 43*h* are arranged in a zigzag fashion.

Figure 2:
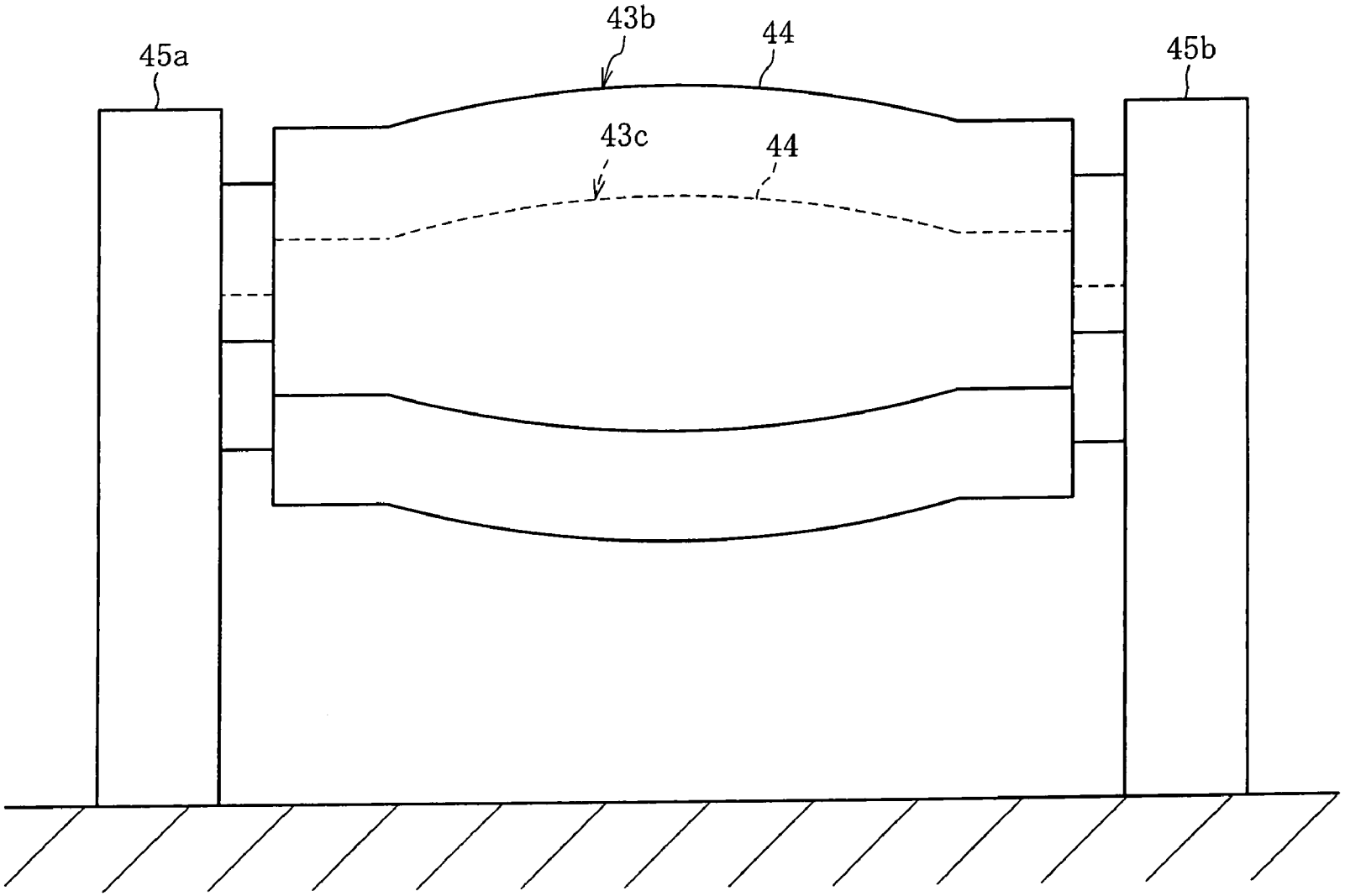
FIG. 2 is a front view of a fiber spreading roller.

As shown in FIG. 2, each of the fiber spreading rollers 43*b* to 43*f* includes a convex curved portion 44 and rotates at a constant position. FIG. 2 depicts a configuration in which a pair of fixed plates 45*a* and 45*b* provided to stand on both sides of the fiber spreading rollers 43*b* to 43*f*, respectively, rotatably supports the fiber spreading rollers 43*b* to 43*f* The fiber bundle 1 is streamed and fed while contacting with the convex curved portions 44 and spread in a width direction along the convex curved portions 44. If the ultrasonic wave is propagated into the liquid by the ultrasonic generator 42, a fiber spreading action of the fiber spreading rollers 43*b* to 43*f* is accelerated. In FIG. 2, the fiber spreading rollers 43*d* to 43*e* are not shown since the fiber spreading roller 43*b* overlaps with the fiber spreading rollers 43*d* and 43*f*, and the fiber spreading roller 43*c* overlaps with the fiber spreading roller 43*e*.

Figure 3:
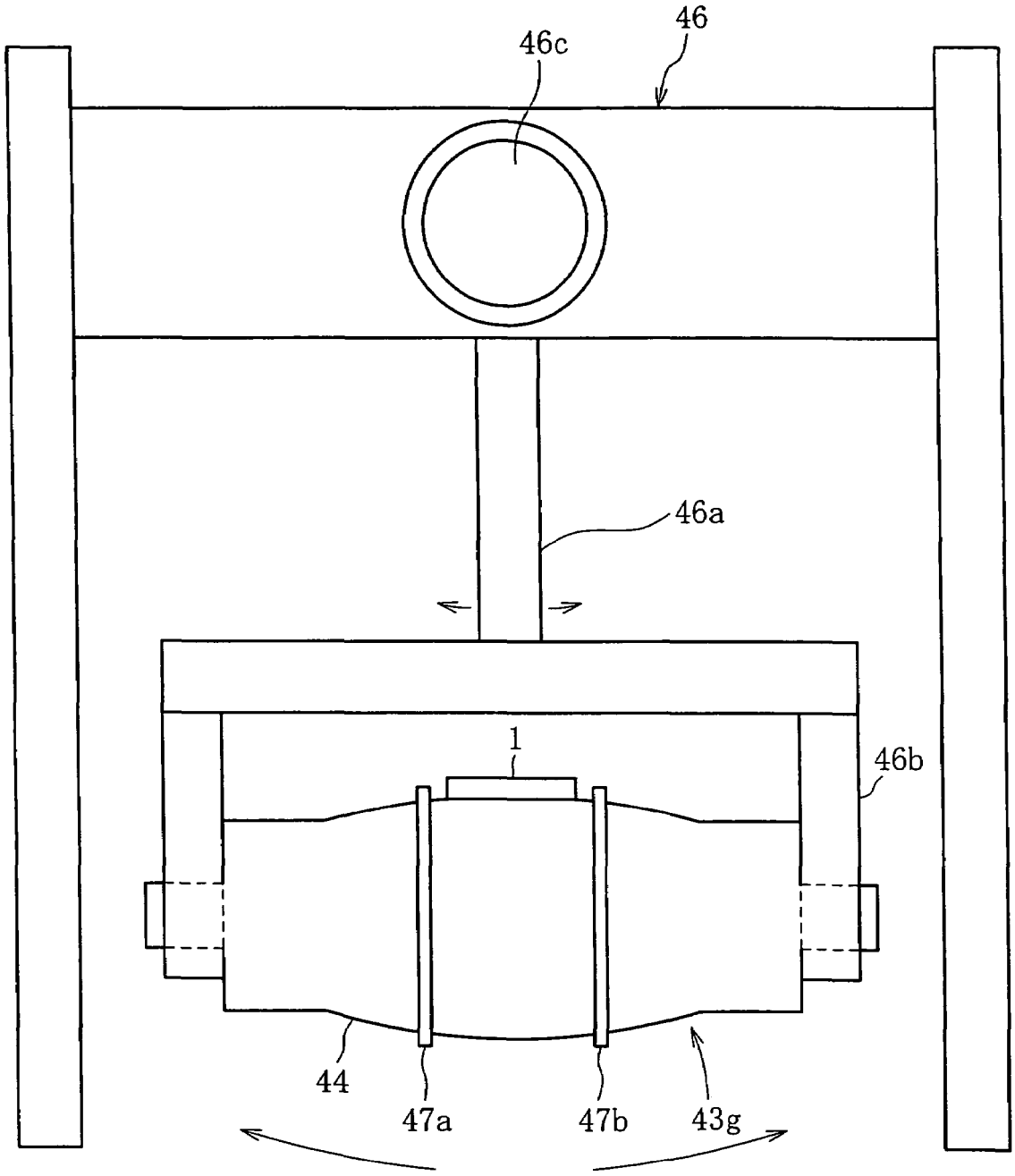
FIG. 3 is a front view of a swing position restriction roller.

Each of the position restriction rollers 43*g* and 43*h* inclines the fiber bundle 1 in a direction (non-horizontal direction in FIG. 1) including a contact force acting direction component of the contact force by which the fiber bundle 1 contacts with the rollers from a state in which the fiber bundle 1 is arranged substantially in parallel to the fiber spreading rollers 43*b* to 43*f*, thereby returning the fiber bundle 1 offset to one side or the other side of the position restriction roller 43*g* or 43*h* in an axial direction to an axially central position thereof. If the fiber spreading function of the fiber spreading rollers 43*b* to 43*f* excessively acts on the fiber bundle 1, the fiber bundle 1 is unnecessarily widened and split apart. The position restriction rollers 43*g* and 43*h* restrict the streaming and feeding position of the fiber bundle 1 and thereby prevent the fiber bundle 1 from being split apart. In this embodiment, the position restriction rollers 43*g* and 43*h* differ in configuration. FIG. 3 depicts one example of the position restriction roller 43*g* and FIG. 4 depicts one example of the other position restriction roller 43*h*.

As shown in FIG. 3, the position restriction roller 43*g* is a swing position restriction roller supported by a swing mechanism 46. The swing mechanism 46 is configured so that a support frame 46*b* that rotatably supports the swing position restriction roller 43*g* is provided on a tip end of an arm 46*a*, and so that a proximal end of the arm 46*a* is pivotally supported by a bearing 46*c*. The arm 46*a* extends from the swing position restriction roller 43*g* toward a side on which the fiber bundle 1 is wound. In this example, the fiber bundle 1 is wound around an upper side of the swing position restriction roller 43*g*, so that the arm 46*a* extends upward from the swing position restriction roller 43*g*. If the fiber bundle 1 is wound around a lower side of the swing position restriction roller 43*g*, which state is not shown, the arm 46*a* extends downward from the swing position restriction roller 43*g*. The swing position restriction roller 43*g* is similar to the fiber spreading rollers 43*b* to 43*f* in that the convex curved portion 44 is provided but different in that a pair of flanges 47*a* and 47*b* is provided on the convex curved portion 44. By providing the swing position restriction roller 43*g* with the paired flanges 47*a* and 47*b*, an upper limit of the spread width of the fiber bundle 1 is set.

The swing position restriction roller 43*g* is given a load from the fiber bundle 1 substantially in a radial direction. If the fiber bundle 1 is spread between the paired flanges 47*a* and 47*b* and a density of the fiber bundle 1 is substantially uniform in the width direction, an axially symmetric load is exerted on the swing position restriction roller 43*g* and the swing position restriction roller 43*g* is kept horizontal. At this time, the swing position restriction roller 43*g* exhibits the same fiber spreading action as that of the fiber spreading rollers 43*b* to 43*f* because of its convex curved portion 44. On the other hand, if the density of the fiber bundle 1 is irregular and the fiber bundle 1 is offset to axially one side or the other side of the swing position restriction roller 43*g*, an axially asymmetric load is exerted on the swing position restriction roller 43*g*. If such an asymmetric load is transmitted to the arm 46*a* through the swing position restriction roller 43*g*, then the arm 46*a* swings about the bearing 46*c*, and turns and inclines the swing position restriction roller 43*g*. In the example of FIG. 3, if the fiber bundle 1 is offset toward a right side in FIG. 3, the swing position restriction roller 43*g* is inclined in a diagonally lower right direction. If the fiber bundle 1 is offset toward a left side in FIG. 3, the swing position restriction roller 43*g* is inclined in a diagonally lower left direction. If the swing position restriction roller 43*g* is inclined, then the tension of the fiber bundle 1 is increased on a lower density side of the fiber bundle 1 and reduced on a higher density side thereof. As a result, the filaments that constitute the fiber bundle 1 are moved from the higher density side to the lower density side, thereby making the density of the fiber bundle 1 uniform. Following this, the swing position restriction roller 43*g* is returned to an original horizontal state.

Figure 4:
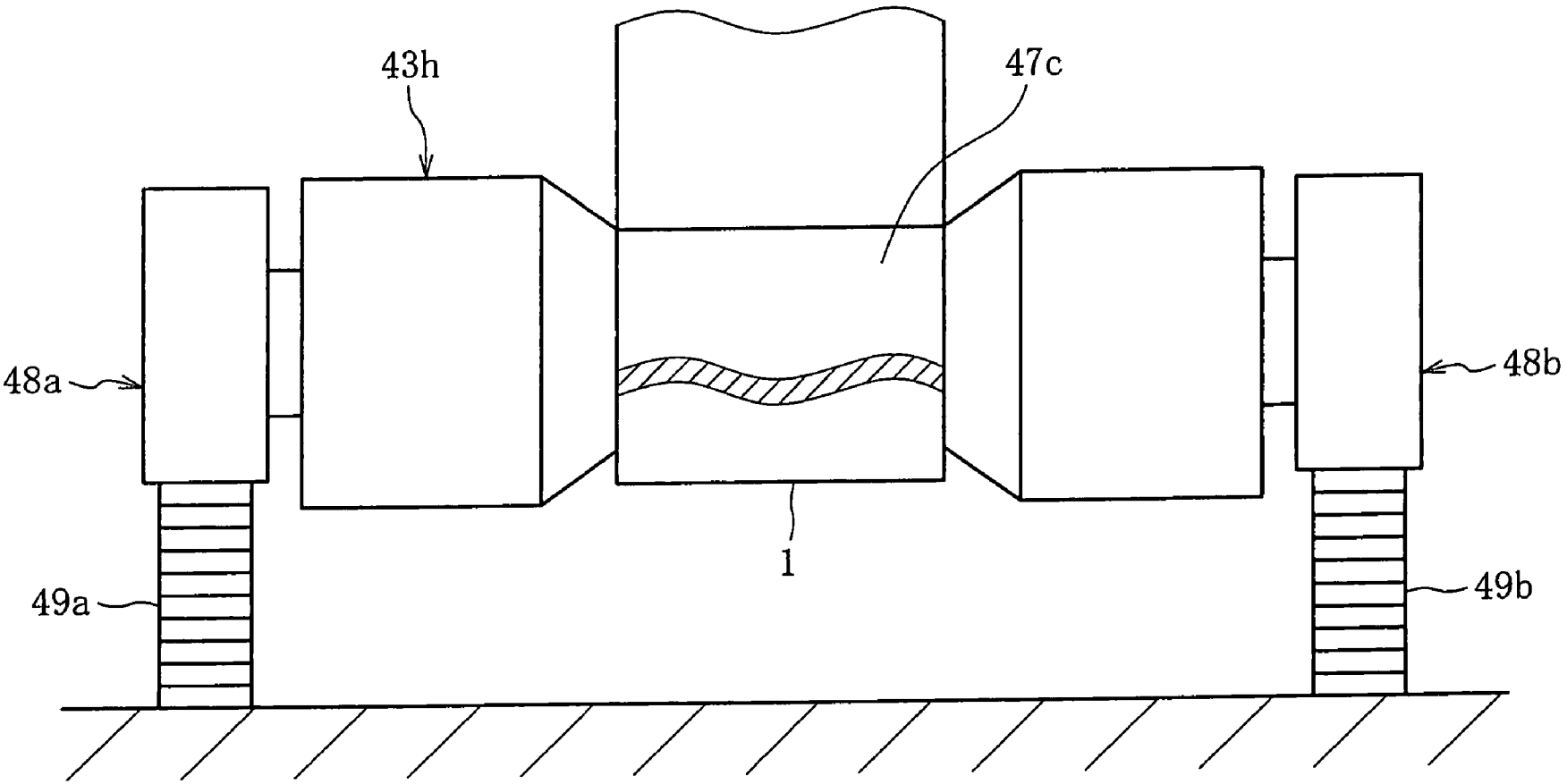
FIG. 4 is a front view of a spring position restriction roller.

As shown in FIG. 4, the other position restriction roller 43*h* is rotatably supported by support columns 48*a* and 48*b* provided to stand on both sides, respectively. The support columns 48*a* and 48*b* include elastically expandable portions 49*a* and 49*b*, respectively. In this example, since the fiber bundle 1 is wound around a lower side of the expansion position restriction roller 43*h*, extension springs are employed as the expandable portions 49*a* and 49*b*, respectively. If the fiber bundle 1 is wound around an upper side of the expansion position restriction roller 43*h*, which state is not shown, compression springs are employed as the respective expandable portions 49*a* and 49*b*, respectively. Alternatively, the extension springs or compression springs can be replaced by fluid pressure cylinders such as hydraulic cylinders or air cylinders. In FIG. 4, a circumferential groove 47*c* that streams and feeds the fiber bundle 1 is provided in a central portion of the expansion position restriction roller 43*h*. This circumferential groove 47*c* is provided to set the upper limit of the spread width of the fiber bundle 1 similarly to the paired flanges 47*a* and 47*b*.

If the fiber bundle 1 is offset to one side or the other side of the expansion position restriction roller 43*h* in the axial direction, an axially asymmetric load is applied to the expansion position restriction roller 43*h*. If this asymmetric load is transmitted to the support columns 48*a* and 48*b* through the expansion position restriction roller 43*h*, the expandable portion of one of the support columns 48*a* and 48*b* expands greater than that of the other support column, thereby elastically inclining the expansion position restriction roller 43*h*. In the example of FIG. 4, if the fiber bundle 1 is offset to a right side, for example, the expansion position restriction roller 43*h* is inclined in a diagonally upper right direction. If the fiber bundle 1 is offset to a left side, the expansion position restriction roller 43*h* is inclined in a diagonally upper left direction. If the expansion position restriction roller 43*h* is inclined, the tension of the fiber bundle 1 is hardly changed on the lower density side of the fiber bundle 1 but reduced on the higher density side thereof. As a result, the filaments that constitute the fiber bundle 1 are moved from the higher density side to the lower density side, thereby making the density of the fiber bundle 1 uniform. Following this, the expansion position restriction roller 43*h* is returned to an original horizontal state.

The swing position restriction roller 43*g* and the expansion position restriction roller 43*h* differ in the following respect. The swing position restriction roller 43*g* is returned from the inclined state to the original state by a balancing action of a balance between the load applied to the swing position restriction roller 43*g* from the fiber bundle 1 and a centripetal force applied to the arm 46*a* as a reactive force to the load. The expansion position restriction roller 43*h* is returned from the inclined state to the original state by elastically restoring actions of the expandable portions 49*a* and 49*b*. The swing position restriction roller 43*g* and the expansion position restriction roller 43*h*, however, exhibit a common function. Namely, by being inclined, each of the swing position restriction roller 43*g* and the expansion position restriction roller 43*h* moves the filaments that constitute the fiber bundle 1 from the higher density side to the lower density side and makes the density of the fiber bundle 1 uniform. These functions are exhibited not only by the respective position restriction rollers 43*g* and 43*h* but also upstream or downstream sides of the rollers 43*g* and 43*h* in the direction in which the fiber bundle 1 is streamed and fed. In this embodiment, these functions act as functions of the fiber spreading rollers 43*b* to 43*f* arranged upstream of the swing position restriction roller 43*g* and the expansion position restriction roller 43*h* for restricting the streaming and feeding position of the fiber bundle 1.

The configurations of the position restriction rollers 43*g* and 43*h* are applicable to the position stabilizing variable roller 33.

As shown in FIG. 1, the squeezing guide section 50 includes a first guide 51, a squeezing roller mechanism 52, and a second guide 53. The squeezing guide section 50 guides the fiber bundle 1 from within the liquid stored in the fiber spreading tank 40 to a drying roller 61 arranged in the drier section 60 while always contacting with the fiber bundle 1 spread in the fiber spreading tank 40.

The first guide 51, a part of which is immersed in the liquid stored in the fiber spreading tank 40, contacts with the fiber bundle 1 streamed and fed by the fiber bundle streaming and feeding section 43 in the liquid of the fiber spreading tank 40, and guides the fiber bundle 1 from within the liquid of the fiber spreading tank 40 to the squeezing roller mechanism 52 while constantly contacting with the fiber bundle 1. In this embodiment, the first guide 51 is configured by one roller so that the fiber bundle 1 can be promptly guided to the squeezing roller mechanism 52 after being drawn from the liquid of the fiber spreading tank 40. Alternatively, the first guide 51 can be configured by a plurality of rollers. If the first guide 51 is configured by a plurality of rollers, a part of at least one roller is immersed in the liquid of the fiber spreading tank 40.

The squeezing roller mechanism 52, which consists of a pair of squeezing rollers 52*a* and 52*b*, squeezes the fiber bundle 1 passed between the squeezing rollers 52*a* and 52*b*, thereby removing the liquid adhering to the fiber bundle 1 in the fiber spreading tank 40. Both of the paired squeezing rollers 52*a* and 52*b* are arranged above a liquid level of the fiber spreading tank 40. One squeezing roller 52*a*, which is arranged above the first guide 51, contacts with the first guide 51 via the fiber bundle 1. The other squeezing roller 52*b*, which is arranged on a side of the squeezing roller 52*a*, contacts with the squeezing roller 52*a* via the fiber bundle 1. Conventionally, a part of one roller is immersed in the liquid so as to be able to promptly squeeze the fiber bundle 1 drawn from the liquid of the fiber spreading tank 40. Due to this, in the conventional squeezing roller mechanism, a large amount of liquid adheres to the one roller even if the fiber bundle is not squeezed. In the squeezing roller mechanism 52, by contrast, only the liquid squeezed out from the fiber bundle 1 and the liquid adhering to the first guide 51 adhere to the one squeezing roller 52*a*, and only the liquid squeezed out from the fiber bundle 1 and the liquid adhering to a surface of the one squeezing roller 52*a* adhere to the other squeezing roller 52*b*. By thus arranging the squeezing roller mechanism 52 above the liquid level of the fiber spreading tank 40 and reducing amounts of the liquids adhering to the respective squeezing rollers 52*a* and 52*b*, squeezing efficiency for squeezing the fiber bundle 1 is enhanced.

The second guide 53 guides the fiber bundle 1 from the squeezing roller mechanism 52 to the drying roller 61 while always contacting with the fiber bundle 1. In this embodiment, the second guide 53 consists of a plurality of guide rollers 53*a* to 53*c*. The guide roller 53*a* on a starting end side is arranged above the squeezing roller mechanism 52 and contacts with the squeezing roller 52*a* of the squeezing roller mechanism 52 via the fiber bundle 1. Alternatively, the guide roller 53*a* on the starting end side may contact with the other squeezing roller 52*b* of the squeezing roller mechanism 52. The guide roller 53*c* on a terminal end side is arranged below the drying roller 61 and contacts with the drying roller 61 via the fiber bundle 1. The intermediate guide roller 53 is arranged between the guide roller 53*a* on the starting end side and the guide roller 53*c* on the terminal end side, and contacts with the guide rollers 53*a* and 53*c* via the fiber bundle 1. In this embodiment, the second guide 53 consists of a plurality of guide rollers 53*a* to 53*c*. Alternatively, the second guide 53 can be configured by one roller.

In FIG. 1, reference symbol 54 denotes an air nozzle. The air nozzle 54 injects a hot wind (dry wind) supplied from the heat source 21, dries the respective constituent elements of the squeezing guide section 50, and preliminarily dries the streamed and fed fiber bundle 1 while contacting with surfaces of the respective constituent elements of the squeezing guide section 50. By doing so, the liquid is evaporated from the surface of the squeezing roller mechanism 52, and liquid removal efficiency of the squeezing roller mechanism 52 is further enhanced.

Further, the first and the second guides 51 and 53 contact with at least one side of the fiber bundle 1, thereby suppressing a surface tension of the liquid contained in the fiber bundle 1 and preventing the filaments from overlapping and the fiber bundle 1 from being split apart.

The drier section 60 includes the drying roller 61 and performs a drying processing by winding the fiber bundle 1 around this drying roller 61. In the drying processing, the drier section 60 heats a surface of the drying roller 61 to thereby evaporate moisture from the spread fiber bundle 1, or supplies a dry wind to the spread fiber bundle 1 wound around the drying roller 61 to thereby absorb the moisture of the spread fiber bundle 1. Alternatively, the drier section 60 simultaneously heats the surface of the drying roller 61 to thereby evaporate moisture from the spread fiber bundle 1, and supplies the dry wind to the spread fiber bundle 1 wound around the drying roller 61 to thereby absorb the moisture of the spread fiber bundle 1.

The main shaft driving roller mechanism 70 consists of a pair of rollers 71 and 72 arranged proximate to each other. One of them is the main shaft driving roller 71 and the other is the press roller 72. The main shaft driving roller 71, which is arranged coaxially with a drive shaft of a driving source, not shown, applies a driving force to the driven shaft driving roller 31 via a power transmission mechanism, not shown. The press roller 72 presses the main shaft driving roller 71 through the fiber bundle 1, thereby transmitting the driving force of the main shaft driving roller 71 to the fiber bundle 1. Conversely, if the press roller 72 is separated from the main shaft driving roller 71, the driving force of the main shaft driving roller 71 is not transmitted to the fiber bundle 1.

The take-up section 80 takes up the spread fiber bundle 1. This take-up section 80 winds the fiber bundle 1 in the form of a tape while overlaying the fiber bundle 1 substantially at the same position. The fiber bundle to be taken up is a bundle of a plurality of filaments differently from a sheet such as a film. Due to this, there is a probability that if the winding positions completely coincide, the filaments bite into the fiber bundle already wound and the fiber bundle cannot be drawn out in the next step or the filaments biting into the fiber bundle are cut. To avoid this disadvantage, the take-up section 80 is configured to be axially movable and takes up the fiber bundle 1 while minutely vibrating.

A tension sensor 81 and a position sensor 82 are provided near the take-up section 80. The tension sensor 81 detects the tension applied to the fiber bundle 1 and transmits a detection result to a control box 83. The spread fiber bundle 1 sometimes has different thicknesses in the width direction and the fiber bundle 1 streamed and fed in this state oscillates in the width direction. The position sensor 82 detects a position at which the fiber bundle 1 oscillates, and transmits a detection result to the control box 83. The control box 83 transmits a signal to the press rollers 32 and 72 and the take-up section 80 based on the detection result of the tension sensor 81. Pressing forces of the press rollers 32 and 72 and the torque of the take-up section 80 are appropriately adjusted according to the signal. In addition, the control box 83 transmits a signal to the take-up section 80 based on the detection result of the position sensor 82. The take-up section 80 is moved axially according to this signal to thereby appropriately adjust the take-up position at which the fiber bundle 1 is taken up.

One embodiment of the present invention has been described so far. However, the present invention is not limited to this embodiment and various changes and modifications can be made to the present invention. For example, in the above-mentioned embodiment, the fiber spreading rollers and the like 43*b* to 43*h* are arranged in the zigzag fashion along the same line in the drawings. However, even if these rollers are arranged along a curve, the fiber bundle 1 follows a bent path. In this case, the bent path which the fiber bundle 1 follows can be a polygonal path bent only on one side or a path having a part of the polygonal shape besides the zigzag path having one side and the other side alternately bent. As can be seen, the bent path which the fiber bundle 1 follows is not limited to that shown in the drawings but can be variously changed.

In the above-stated embodiment, the paired flanges 47*a* and 47*b* are provided on the swing position restriction roller 43*g*. Alternatively, these flanges 47*a* and 47*b* may be provided on part of or all of each of the fiber spreading rollers 43*b* to 43*f* or on the expansion position restriction roller 43*h*. The fiber spreading rollers 43*b* to 43*f* each provided with the flanges 47*a* and 47*b* also serve as position restriction rollers.

In the above-stated embodiment, as the swing arm 46*a*, the arm having the proximal end pivotally supported by the bearing 46*c* is employed. However, the arm 46*a* can be configured to be swingable by causing the proximal end thereof to be supported by an elastically bendable bent member (e.g., a plate spring or a coil spring) or by providing the bent member on the arm 46*a*.

Further, the position restriction rollers of plural types may be used not in combination but solely. These position restriction rollers can restrict the spread width of the fiber bundle 1 even if they are used not in the liquid but in the gas.

In the above-stated embodiment, each of the first guide 51 and the second guide 53 is configured by one or a plurality of rollers. Alternatively, a guide plate can be employed in place of the roller or rollers. As the guide plate, a plate curved like a roller surface rather than a flat plate is preferably used so as to improve the contact force of the plate by which the plate contacts with the fiber bundle 1.

Moreover, in the above-stated embodiment, the present invention is applied to the fiber spreading apparatus using the ultrasonic fiber spreading method. However, the present invention is also applicable to a fiber spreading apparatus using the other fiber spreading method such as the electrostatic fiber spreading method, the fiber pressing and spreading method or the fiber jet-spreading method.

What is claimed is:

1. A fiber spreading apparatus for spreading a fiber bundle consisting of an assembly of a plurality of filaments in a fiber assembly streaming and feeding section that streams and feeds the fiber bundle to follow a bent path while a tension is applied to the fiber bundle and the fiber bundle is brought into contact with surfaces of a plurality of fiber spreading rollers, wherein the fiber bundle streaming and feeding section includes a position restriction roller that restricts a streaming and feeding position of the fiber bundle, a pair of flanges that restrict a spread width of the fiber bundle being provided on an outer circumferential portion of the position restriction roller.

2. A fiber spreading apparatus for spreading a fiber bundle consisting of an assembly of a plurality of filaments in a fiber assembly streaming and feeding section that streams and feeds the fiber bundle to follow a bent path while a tension is applied to the fiber bundle and the fiber bundle is brought into contact with surfaces of a plurality of fiber spreading rollers, wherein the fiber bundle streaming and feeding section includes a position restriction roller that restricts a streaming and feeding position of the fiber bundle, and is configured to return the fiber bundle offset to one side or the other side of the position restriction roller in an axial direction to a center of the position restriction roller by tilting the position restriction roller.

3. The fiber spreading apparatus according to claim 2, wherein the position restriction roller is rotatably supported by a tip end of a swing arm.

4. The fiber spreading apparatus according to claim 3, wherein a proximal end of the arm extends from the position restriction roller to a side around which the fiber bundle is wound, and is pivotally supported by a bearing.

5. The fiber spreading apparatus according to claim 2, wherein the position restriction roller returns the fiber bundle to the center by elastically changing a gradient according to an offset state of the fiber bundle.

6. The fiber spreading apparatus according to claim 3, wherein the position restriction roller returns the fiber bundle to the center by elastically changing a gradient according to an offset state of the fiber bundle.

7. A fiber spreading apparatus for spreading a fiber bundle consisting of an assembly of a plurality of filaments in a fiber bundle streaming and feeding section arranged in a liquid, and for squeezing the liquid adhering to the spread fiber bundle and removing the liquid using a squeezing roller mechanism, the fiber bundle streaming and feeding section streaming and feeding the fiber bundle to follow a bent path while a tension is applied to the fiber bundle and the fiber bundle is brought into contact with surfaces of a plurality of fiber spreading rollers, wherein the squeezing roller mechanism includes a first guide that is arranged outside the liquid stored in a fiber spreading tank, and that guides the fiber bundle from within the liquid in the fiber spreading tank to the squeezing roller mechanism while contacting with the fiber bundle without separating from the fiber bundle.

8. The fiber spreading apparatus according to claim 7, further comprising a drier section that winds the fiber bundle streamed and fed from the squeezing roller mechanism around a drying roller and dries the fiber bundle, wherein the squeezing roller mechanism includes a second guide that guides the fiber bundle from the squeezing roller mechanism to the drying roller while contacting the fiber bundle without separating from the fiber bundle.

* * * * *